US007008972B2

(12) United States Patent
Sullivan et al.

(10) Patent No.: US 7,008,972 B2
(45) Date of Patent: Mar. 7, 2006

(54) GOLF BALL COMPRISING MICROPOROUS MATERIALS AND METHODS FOR IMPROVING PRINTABILITY AND INTERLAYER ADHESION

(75) Inventors: Michael J. Sullivan, Barrington, RI (US); Kevin M. Harris, New Bedford, MA (US); Lawrence Fitzgerald, Gibsonia, PA (US)

(73) Assignee: Acushnet Company, Fairhaven, MA (US)

( * ) Notice: Subject to any disclaimer, the term of this patent is extended or adjusted under 35 U.S.C. 154(b) by 91 days.

(21) Appl. No.: 10/459,488

(22) Filed: Jun. 12, 2003

(65) Prior Publication Data

US 2004/0254255 A1 Dec. 16, 2004

(51) Int. Cl.

| | |
|---|---|
| ***A63B 37/00*** | (2006.01) |
| ***A63B 37/06*** | (2006.01) |
| ***A63B 37/12*** | (2006.01) |
| ***C08J 9/00*** | (2006.01) |

(52) U.S. Cl. ..... 521/64; 521/143; 524/493; 473/371; 473/372; 473/378; 473/385

(58) Field of Classification Search ..... 521/64, 521/143; 524/493; 473/371, 372, 378, 385
See application file for complete search history.

(56) References Cited

U.S. PATENT DOCUMENTS

| | | | | |
|---|---|---|---|---|
| 3,351,495 | A | 11/1967 | Larsen et al. | 136/146 |
| 4,274,637 | A | 6/1981 | Molitor | 273/235 R |
| 4,454,253 | A * | 6/1984 | Murphy et al. | 521/112 |
| 4,473,665 | A | 9/1984 | Martini-Vvedensky et al. | 521/79 |
| 4,560,168 | A | 12/1985 | Aoyama | 273/232 |
| 4,836,552 | A * | 6/1989 | Puckett et al. | 473/372 |
| 4,861,644 | A | 8/1989 | Young et al. | 428/195 |
| 4,925,193 | A | 5/1990 | Melvin et al. | 273/232 |
| 4,960,281 | A | 10/1990 | Aoyama | 273/232 |
| 5,006,297 | A | 4/1991 | Brown et al. | 263/234 |
| 5,160,674 | A | 11/1992 | Colton et al. | 264/50 |
| 5,248,878 | A | 9/1993 | Ihara | 219/121.69 |
| 5,249,804 | A | 10/1993 | Sanchez | 273/232 |
| 5,334,673 | A | 8/1994 | Wu | 273/235 R |
| 5,484,870 | A | 1/1996 | Wu | 528/28 |
| 5,562,552 | A | 10/1996 | Thurman | 473/379 |
| 5,575,477 | A | 11/1996 | Hwang | 473/379 |
| 5,688,181 | A | 11/1997 | Albert | 473/61 |
| 5,688,191 | A | 11/1997 | Cavallaro et al. | 473/373 |
| 5,713,801 | A | 2/1998 | Aoyama | 473/354 |
| 5,733,428 | A | 3/1998 | Calabria et al. | 264/134 |
| 5,779,561 | A * | 7/1998 | Sullivan et al. | 473/373 |
| 5,803,831 | A | 9/1998 | Sullivan et al. | 473/374 |
| 5,820,488 | A | 10/1998 | Sullivan et al. | 473/374 |
| 5,849,168 | A | 12/1998 | Lutz | 264/755 |
| 5,885,172 | A | 3/1999 | Hebert et al. | |
| 5,919,100 | A | 7/1999 | Boehm et al. | 473/354 |
| 5,957,787 | A | 9/1999 | Hwang | 473/379 |
| 5,965,669 | A | 10/1999 | Cavallaro et al. | 525/221 |
| 5,981,654 | A | 11/1999 | Rajagopalan | 525/66 |
| 5,981,658 | A | 11/1999 | Rajagopalan et al. | 525/72 |
| 6,056,842 | A | 5/2000 | Dalton et al. | 156/243 |
| 6,075,223 | A | 6/2000 | Harrison | 219/121.85 |
| 6,099,415 | A | 8/2000 | Lutz | 473/357 |
| 6,114,023 | A | 9/2000 | Schwarz et al. | 428/315.5 |
| 6,129,881 | A | 10/2000 | Puniello | 264/278 |
| 6,149,535 | A | 11/2000 | Bissonnette et al. | 473/354 |
| 6,180,040 | B1 | 1/2001 | Ladd et al. | 264/248 |
| 6,180,722 | B1 | 1/2001 | Dalton et al. | 525/193 |
| 6,207,784 | B1 | 3/2001 | Rajagopalan | 528/71 |
| 6,213,898 | B1 | 4/2001 | Ogg | 473/383 |
| 6,235,230 | B1 | 5/2001 | Puniello | 264/278 |
| 6,241,622 | B1 | 6/2001 | Gobush et al. | 473/199 |
| 6,248,804 | B1 | 6/2001 | Lutz | 523/160 |
| 6,286,364 | B1 | 9/2001 | Aoyama et al. | 73/65.03 |
| 6,290,615 | B1 | 9/2001 | Ogg | 473/378 |
| 6,315,915 | B1 | 11/2001 | Hebert et al. | 216/67 |
| 6,329,458 | B1 | 12/2001 | Takesue et al. | 524/400 |
| 6,338,684 | B1 | 1/2002 | Winfield et al. | 473/378 |
| 6,353,058 | B1 | 3/2002 | Rajagopalan | 525/179 |
| 6,358,161 | B1 | 3/2002 | Aoyama | 473/383 |
| 6,379,138 | B1 | 4/2002 | Puniello et al. | 425/116 |
| 6,383,092 | B1 | 5/2002 | Ogg | 473/378 |
| 6,386,992 | B1 * | 5/2002 | Harris et al. | 473/371 |
| 6,409,615 | B1 | 6/2002 | McGuire et al. | 473/383 |
| 6,414,082 | B1 | 7/2002 | Rajagopalan et al. | 525/74 |
| 6,462,303 | B1 | 10/2002 | Brown | 219/121.69 |
| 6,467,130 | B1 | 10/2002 | Kurachi et al. | 16/438 |
| 6,488,591 | B1 | 12/2002 | Gobush et al. | 473/199 |
| 6,494,795 | B1 | 12/2002 | Sullivan | 473/372 |
| 6,500,073 | B1 | 12/2002 | Gobush et al. | 473/199 |
| 6,500,495 | B1 | 12/2002 | Lutz | 427/500 |
| 6,629,898 | B1 | 10/2003 | Nardacci | 473/373 |
| 2001/0009310 | A1 | 7/2001 | Herbert et al. | |
| 2001/0018375 | A1 | 8/2001 | Hayashi et al. | |
| 2001/0019971 | A1 | 9/2001 | Hayashi et al. | |

(Continued)

OTHER PUBLICATIONS

Katz, Handbook of Fillers and Reinforcements for Plastics, 1978, pp. 141-142.*

(Continued)

*Primary Examiner*—David J. Buttner
(74) *Attorney, Agent, or Firm*—Swidler Berlin LLP

(57) ABSTRACT

Golf balls and methods of making same having at least one layer including a microporous composition, wherein the microporous composition includes a polymer component and a filler component and interconnecting pores, so as to improve adhesion between layers, printability of layers, and increase the cure time of the layers and the overall golf ball.

20 Claims, 2 Drawing Sheets

U.S. PATENT DOCUMENTS

| | | | |
|---|---|---|---|
| 2002/0025862 | A1 | 2/2002 | Sullivan et al. |
| 2002/0028885 | A1 | 3/2002 | Sullivan et al. |
| 2002/0082358 | A1 | 6/2002 | Ohira et al. |
| 2002/0151380 | A1 | 10/2002 | Sullivan |

OTHER PUBLICATIONS

U.S. Appl. No. 10/339,603, filed Jan. 10, 2003 entitled "Polyurethane Compositions for Golf Balls".
U.S. Appl. No. 10/228,311, filed Aug. 27, 2002 entitled "Golf Balls Comprising Light Stable Materials and Methods of Making the Same".
U.S. Appl. No. 10/229,344, filed Aug. 27, 2002 entitled "Golf Balls Comprising Glass Ionomers, Ormocers, or Other Hybrid Organic/Inorganic Compositions".
U.S. Appl. No. 10/190,705, filed Jul. 9, 2002 entitled "Low Compression, Resilient Golf Balls With Rubber Core".
U.S. Appl. No. 10/167,744, filed Jun. 13, 2002 entitled "Golf Ball with Multiple Cover Layers".
U.S. Appl. No. 10/138,304, filed May 6, 2002 entitled "Golf Ball Incorporating Grafted Metallocene Catalyzed Polymer Blends".
U.S. Appl. No. 10/078,417, filed Feb. 21, 2002 entitled "Dimple Patterns for Golf Balls".
U.S. Appl. No. 10/012,538, filed Dec. 12, 2001 entitled "Method of Forming Indicia on a Golf Ball ".
U.S. Appl. No. 09/989,191, filed Nov. 21, 2001 entitled "Golf Ball Dimples With a Catenary Curve Profile".
U.S. Appl. No. 09/923,071, filed Aug. 6, 2001 entitled "Golf Balls Including a Staged Resin Film and Methods of Making Same".
U.S. Appl. No. 09/841,910, filed Apr. 27, 2001 entitled "Multilayer Golf Ball With Hoop-Stress Layer".
U.S. Appl. No. 09/842,829, filed Apr. 27, 2001 entitled "All Rubber Golf Ball With Hoop-Stress Layer".
U.S. Appl. No. 09/767,723, filed Jan. 24, 2001 entitled "Multi-Layer Golf Ball".
U.S. Appl. No. 09/742,435, filed Dec. 22, 2000 entitled "Split Vent Pin for Injection Molding".
U.S. Appl. No. 09/717,136, filed Nov. 22, 2000 entitled "Method of Making Golf Balls".
U.S. Appl. No. 09/442,845, filed Nov. 18, 1999 entitled "Mold for a Golf Ball" (Japanese Abstract submitted).

* cited by examiner

GOLF BALL COMPRISING MICROPOROUS MATERIALS AND METHODS FOR IMPROVING PRINTABILITY AND INTERLAYER ADHESION

FIELD OF THE INVENTION

The present invention relates to golf balls having at least one layer including a microporous composition. In particular, the microporous compositions of the invention increase adhesion and improve golf ball processing, i.e., printing, coating, marking, etc.

BACKGROUND OF THE INVENTION

Golf ball manufacturers have been experimenting with various materials and manufacturing methods for golf balls over the years in an attempt to further refine the manufacturing process. Some examples of issues that manufacturers typically face during manufacturing include golf ball layer adhesion, golf ball printability, and golf ball durability. For example, most manufacturers use ionomer resins for at least one golf ball component because of their durability, rebound, and scuff resistance characteristics. The recent trend toward light stable cover materials, however, has introduced durability and adhesion issues, particularly between an ionomer resin inner cover layer and a polyurethane/polyurea outer cover layer. In fact, the inner components of most commercially available polyurethane golf balls are surface treated, e.g., corona discharge/silane dipping, to overcome the adhesion problems. The surface treatment, however, adds cost and time to the manufacturing process.

Printing and coating an outer surface of a golf ball may also impose manufacturing difficulties, due, in part, to the dimpled, spherical surface and the variety of materials needed to be printed upon. Thus, many patents have issued for various methods of printing on a golf ball or coating a golf ball. Regardless of the method, however, if the material used to form the surface layer is resistant to paint, ink, or the like, the golf ball cannot be adequately processed after forming. To obviate this problem, most outer surface layers are either primed or surface treated prior to coating and/or printing. For example, flame treatment, chlorination, corona discharge, and combinations thereof have been employed before post-processing to remove the problem of adhesion between the paint and the polyolefin substrate. Another disadvantage is that different substrates do not accept all types of paints or printing inks.

Moreover, most compositions used in golf ball layers have a particular cure time that lengthens the manufacturing process. For example, polyurethane compositions typically include a prepolymer component and a curing agent. When the polyurethane material is cast or molded onto the ball, sufficient time must elapse prior to further processing to allow the polyurethane composition to cure adequately, which increases manufacturing time and decreases productivity. In addition, if printing or painting is attempted too soon, i.e., the layer is not allowed to adequately cure, defects from wet transfer may occur.

Some manufacturers have attempted to use highly neutralized polymers in place of the typical cover layer materials, i.e., inner and outer cover layers, in an attempt to overcome the problems addressed above. Potential compatibility issues remain with these fatty acid-based highly neutralized polymers, such as those discussed in U.S. Pat. No. 6,329,458, however, due to their hydrophobic backbone moiety. For example, the fatty acids may vaporize during injection molding, generating a large amount of gas, which may lead to molding defects, including adhesion problems. In addition, the presence of this gas may also result in gas constituents settling on the surface of the molded object, which greatly lowers the paintability and post-processing of the object.

Thus, a need exists in the golf ball art for a material that facilitates post-processing steps like painting, coating, and printing. In addition, a need exists for improved golf ball layer materials that reduce or eliminate adhesion problems with other layer materials. Moreover, a composition that cures/dries rapidly to a tack free state will eliminate defects caused by wet transfer.

SUMMARY OF THE INVENTION

The present invention is directed to a golf ball including at least one structural layer formed of a microporous composition including: at least one polyolefin polymer; a finely divided particulate filler comprising at least about 50 percent by weight of siliceous particles; and a network of interconnecting pores communicating substantially throughout the microporous composition, wherein the finely divided particulate filler is present in an amount of about 40 percent or greater. In one embodiment, the finely divided particulate filler includes precipitated silica, a silica gel, fumed silica.

The interconnecting pores may have a volume average diameter of about 0.02 microns to about 50 microns. In addition, the finely divided particulate filler may have an average particle size of about 100 nm or less. In one embodiment, the finely divided particulate filler has an average particle size of about 5 microns to about 40 microns.

In one embodiment, the polyolefin polymer includes ionomer resins, grafted and ungrafted metallocene-catalyzed polymers, single site catalyzed olefinic polymers, polyurethanes, polyureas, polyurethane-ionomers, polyurea-ionomers, polybutadiene, polyisoprene, ethylene propylene rubber, ethylene propylene diene monomer, styrene diene rubber block copolymers, polyamide, polyester, polyesteramide block copolymers, polyester-ether block copolymers, polyethylene-acrylic copolymers, polyethylene-methacrylic acid copolymers, polyethylene-acrylic terpolymer, polyethylene-methacrylic acid terpolymers, or mixtures thereof.

In another embodiment, the golf ball includes a core, a cover, and at least one layer formed of the microporous composition disposed between the core and the cover.

The present invention is also directed to a golf ball that includes a core and a cover, wherein the cover is formed of a microporous composition including: a polymer component; and a finely divided silicate filler, wherein the microporous composition includes pores including about 35 percent or greater of the volume of the microporous composition, and wherein the pores have a volume average diameter of about 0.02 microns to about 50 microns.

In one embodiment, the finely divided silicate filler has an average particle size of about 50 nm or less. In another embodiment, the pores comprise about 60 percent or greater of the volume of the microporous composition. In still another embodiment, the pores have a volume average diameter of about 0.05 microns to about 30 microns.

In addition, the core may include a rubber-based material. Furthermore, the microporous composition may further include a density-adjusting filler. Finally, the microporous composition may further include a processing plasticizer.

DETAILED DESCRIPTION OF THE INVENTION

Figure 1:
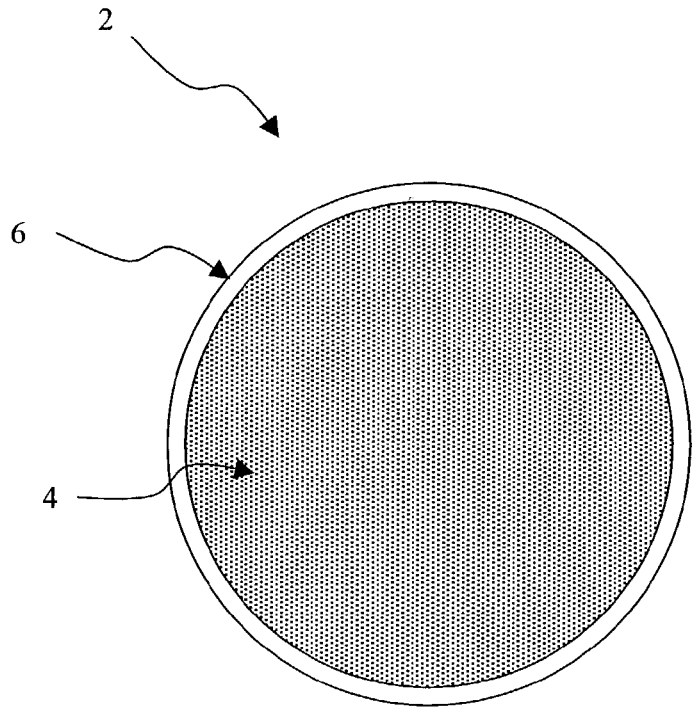
FIG. 1 is a cross-sectional view of a two layer ball, wherein at least a portion of the golf ball is formed from the compositions of the invention.

The present invention is directed to a golf ball including at least one layer formed from a microporous composition (MPC). In addition, the present invention relates to methods of forming the MPCs of the invention, as well as golf balls including MPC layers. In particular, the MPCs of the present invention advantageously improve layer adhesion, layer post-processing, and layer/golf ball curing times. For example, when an MPC layer of the present invention is printed upon, the printed image is sharper than images printed on more conventional golf ball layer materials because of the mechanical locking potential of the porous network. In addition, the use of an MPC reduces or eliminates the need for surface treatment prior to printing or topcoating. Furthermore, when used in an inner cover layer, for example, adhesion between the inner cover layer and the outer cover layer is greatly improved over that of conventional inner cover layer materials, such as ionomers, also reducing or eliminating the need for surface treatment.

The compositions of the invention have interconnecting pores and preferably include a polymer component and a filler. The MPC may be included in any layer of a golf ball, e.g., core, cover, and any layers therebetween, and may be applied as a liquid or solid composition. All types of golf balls are contemplated by the present invention, i.e., the compositions of the invention may be used in unitary balls, two-layer balls, three-layer balls, and balls having more than three-layers, which will be discussed in more detail below.

Compositions of the Invention

The MPCs of the present invention may include a variety of polymer components. The composition preferably also includes at least one filler. In addition, the MPCs are characterized by a network of interconnecting pores communicating throughout the MPC.

Polymer Component

The polymer component of the present invention may be any suitable polyolefin polymer. The polymer component may be a single polymer or mixture of polymers including homopolymers, copolymers, random copolymers, block copolymers, graft copolymers, atactic polymers, isotactic polymers, syndiotactic polymers, linear polymers, or branched polymers. When mixtures of polymers are used, the mixture may be homogeneous or it may comprise two or more polymeric phases.

Nonlimiting examples of suitable polymer components include thermoplastic polyolefins, poly(halo-substituted olefins), polyesters, polyamides, polyurethanes, polyureas, poly (vinyl halides), poly(vinylidene halides), polystyrenes, poly (vinyl esters), polycarbonates, polyethers, polysulfides, polyimides, polysilanes, polysiloxanes, polycaprolactones, polyacrylates, and polymethacrylates. In addition, thermoplastic poly(ester-amides), poly(silane-siloxanes), and poly (ether-esters) are suitable for use with the present invention.

In one embodiment, the polymer component of the MPC is preferably a polyolefin polymer, such as low density polyethylene (LDPE), high density polyethylene (HDPE), polytetrafluoroethylene, polypropylene (atactic, isotactic, or syndiotactic) and copolymers thereof, ethylene copolymer, propylene copolymer, copolymers of ethylene and propylene, copolymers of ethylene and butene, ethylene acrylic acid ionomers, ethylene methacrylic acid ionomers, polystyrene, poly(omega-aminoundecanoic acid) poly(hexamethylene adipamide), poly(epsilon-caprolactam), poly(methyl methacrylate), poly(vinyl acetate), poly(vinyl chloride), poly(vinylidene chloride), copolymers of vinylidene chloride and vinyl acetate, copolymers of vinylidene chloride and vinyl chloride, and mixtures thereof. In another embodiment, the polyolefin polymer is a linear ultrahigh molecular weight polyolefin, such as ultra high molecular weight polyethylene.

In yet another embodiment, the composition includes a polymer component including at least one of a thermoplastic or thermoset material. Nonlimiting examples include, but are not limited to, ionomer resins; grafted and ungrafted metallocene-catalyzed polymers, such as those disclosed in U.S. Pat. No. 6,414,082 (incorporated by reference in its entirety); single site catalyzed olefinic polymers, such as those disclosed in U.S. Pat. No. 6,467,130 (incorporated in its entirety by reference herein); thermoplastic and thermoset polyurethanes (those having purely urethane groups as well as those having a portion of urea groups); thermoplastic and thermoset polyureas (those having purely urea groups as well as those having a portion of urethane groups); polyurethane-ionomers and polyurea-ionomers, such as those disclosed in U.S. Pat. No. 6,207,784 (incorporated in its entirety by reference herein); polybutadiene; polyisoprene; ethylene propylene rubber; ethylene propylene diene monomer; styrene diene rubber block copolymers; polyamide; polyester; polyester-amide block copolymers, such as PEBAX® (manufactured by Atofina); polyester-ether block copolymers, such as HYTREL® (manufactured by DuPont); polyethylene-acrylic or methacrylic acid copolymers, such as NUCREL® (manufactured by DuPont) and PRIMACOR® (manufactured by Dow); polyethylene-acrylic or methacrylic acid terpolymers, such as ESCOR® ATX (manufactured by Exxon Chemical Co.) and NUCREL®; or mixtures thereof.

The ionomer component useful in the present invention is a polymer that includes negatively charged acid groups, such as carboxylate or sulfonate, or positively charged basic groups, such as quaternary nitrogen, the acidic or basic groups being at least partially neutralized with a conjugate acid or base. The negatively charged acid groups may be partially, highly, or fully neutralized with a cation, such as a metal ion, whereas positively charged basic groups may be neutralized with an anion, such as a halide, an organic acid, or an organic halide. For the purposes of this invention, the term "partially neutralized" generally includes acid groups neutralized from about 20 mol percent to about 80 mol percent, the term "highly neutralized" generally includes acid groups neutralized from about 81 mol percent to about 99 mol percent, and the term "fully neutralized" includes acid groups neutralized to 100 mol percent. Methods of incorporating the acidic or basic groups are described in U.S. Pat. No. 6,353,058, which is incorporated by reference herein in its entirety.

The ionomers useful in the compositions of the invention are typically thermoplastic ionomers, and include, but are not limited to, olefin, polyester, copoly(ether-ester), copoly (ester-ester), polyamide, polyether, polyurethane, polyacrylate, polystyrene, SBS, SEBS, and polycarbonate homopolymer, copolymer and block copolymer ionomers. In one embodiment, the ionomer is a copolymer of an olefin and an α,β-ethylenically unsaturated carboxylic acid, where at least a portion of the carboxylic acid groups are at least partially neutralized with a metal ion. In another embodiment, the olefin is ethylene, and the α,β-ethylenically unsaturated carboxylic acid is acrylic or methacrylic acid, where the metal ion is zinc, sodium, magnesium, manganese, calcium, lithium or potassium.

In one embodiment, the MPC includes a grafted metallocene-catalyzed polymer formed by grafting an ethylenically-unsaturated monomer onto a metallocene-catalyzed polymer selected from the group consisting of polyethylene and copolymers of ethylene with propylene, butene, pentene, hexene, heptene, octene, and norbornene. In another embodiment, the grafted metallocene-catalyzed polymer is formed by grafting an ethylenically-unsaturated monomer onto a metallocene-catalyzed polymer selected from the group consisting of polyethylene and copolymers of ethylene with butene.

In addition, novel hybrid materials, such as glass ionomers, ormocers, and other inorganic-organic materials, such as the ones disclosed in co-pending U.S. patent application Ser. No. 10/229,344, filed Aug. 27, 2002, entitled "Golf Balls Comprising Glass Ionomers, Ormocers, or Other Hybrid Organic/Inorganic Compositions," the disclosure of which is incorporated by reference, may be used in the compositions of the present invention. As used herein, the term "hybrid material" includes glass ionomers, resin-modified glass ionomers, ormocers, inorganic-organic materials, silicon ionomers, dental cements or restorative compositions, polymerizable cements, ionomer cements, metal-oxide polymer composites, ionomer cements, aluminofluorosilicate glasses, fluoroaluminosilicate glass powders, polyalkenoate cements, flexible composites, and blends thereof.

As known to those of ordinary skill in the art, the intrinsic viscosity of a polyolefin polymer will vary depending on the type of polyolefin. One suitable way of determining intrinsic viscosity of the polymer component is exptrapolate to zero concentration the reduced viscosities of several dilute solutions of the polyolefin where the solvent is freshly distilled decahydronapththalene to which 0.2 percent by weight 3,5-di-tert-butyl-4-hydroxyhydrocinnamic acid, neopentanetetryl ester has been added. This method is further explained in U.S. Pat. No. 4,861,644, which is incorporated in its entirety by reference herein. The intrinsic viscosity of the polyolefin polymer is preferably about 6 deciliters/gram (dL/g) or greater. While there is no particular upper limit on the intrinsic viscosity, in one embodiment, the intrinsic viscosity is about 39 dL/g or less. In one embodiment, the intrinsic viscosity is about 19 dL/g or greater. In another embodiment, the intrinsic viscosity is about 18 dL/g or less.

The polymer component is preferably present in an amount sufficient to provides its properties to the MPC. The polymer component of the composition is preferably present in an amount from about 10 percent to about 100 percent by weight of the composition. In one embodiment, the polymer component is present in an amount of about 15 percent or greater by weight of the composition. In another embodiment, the polymer component is present in an amount of about 90 percent or less by weight of the composition. In yet another embodiment, the polymer component is present in an amount of about 20 percent to about 80 percent by weight of the composition. In still another embodiment, the polymer component is present in an amount of about 50 percent to about 99 percent by weight of the composition.

Filler(s)

The MPCs of the present invention preferably include at least one finely divided particulate filler. In one embodiment, at least about 50 percent of the filler includes siliceous particles. Because of the generic structure of silicates, i.e., a tetrahedron shaped anionic group:

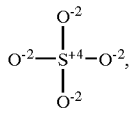

the oxygen atoms have the option of bonding to another silicon ion and, therefore, linking one silicate to another. Thus, the silicates are beneficial in the compositions of the invention due to the different ways that silicate tetrahedrons combine, i.e., as single units, double units, sheets, chains, rings, and framework structures. For example, the tectosilicate subclass have structures composed of interconnected tetrahedrons going outward in all directions forming an intricate framework analogous to the framework of a large building. Thus, the interconnected pores of the MPCs are due, at least in part, to the interconnected tetrahedrons of the silicates included in the composition.

Examples of suitable silicates include, but are not limited to, those in the nesosilicate group (single tetrahedrons), the sorosilicate group (double tetrahedrons), the inosilicate group (single and double chains), the cyclosilicate group (rings), the phyllosilicate group (sheets), and the tectosilicate group (frameworks). Specific examples include, but are not limited to, silica; mica (e.g., biotite, lepidolite, muscovite, phlogopite, and zinnwaldite), montmorillonite, kaolinite (aluminum silicate hydroxide); asbestos; talc (magnesium silicate hydroxide); diatomaceous earth; vermiculite; natural and synthetic zeolites (e.g., analcime, chabazite, harmotome, heulandite, laumontite, mesolite, natrolite, phillipsite, scolecite, stellerite, stilbite, and thomsonite); cement; wollastonite (calcium silicate); andalusite, kyanite, and sillimanite (aluminum silicate); albite (sodium aluminum silicate); aluminum polysilicate; and glass particles.

The silicate may be in the form of ultimate particles, aggregates of ultimate particles, or mixtures thereof. For example, the silicate may be precipitated silica, a silica gel, fumed silica, or a combination thereof. As known to those of ordinary skill in the art, the different types of silicates have different properties. For example, silica gel does not precipitate and is a coherent, rigid, three-dimensional network of contiguous particles of colloidal amorphous silica, whereas precipitated silica includes precipitated aggregates of ultimate particles of colloidal amorphous silica that have not existed at any time as macroscopic gel. In addition, precipitated silica powders typically have a more open structure, i.e., a higher specific pore volume, but tend to have lower specific surface area than silica gel.

In one embodiment, precipitated silica is used in the composition with the polymer component. The precipitated silica is typically produced by combining an aqueous solution of a soluble alkali metal silicate and an acid so that colloidal particles will grow in weakly alkaline solutions and be coagulated by the alkali metal ions of the resulting soluble alkali metal salt. The acid may be one of sulfuric acid, hydrochloric acid, carbon dioxide, or a mixture thereof.

As mentioned, the silicate may also be in the form of silica gel. For example, alumina silica gel is a suitable silicate for inclusion in the MPC. The gel form contains millions of tiny pores that adsorb and hold moisture, e.g., silica can absorb about 40 percent of its weight in moisture. In addition, fumed silica may be used in the MPC, which is beneficial, at least in part, because fumed silica particles are submicron size and are thus able to easily move through the macromolecules of the polymer component. Moreover, the three dimensional network of the fumed silica prevents pigments from settling. Suitable commercially available fumed silica includes hydrophilic and hydrophobic AEROSIL from Degussa Corp of Waterford, N.J.

The filler preferably has a particle size of about 1 nm to about 40 microns, which depends on the type of silicate used. In one embodiment, the filler is submicron size and has an average particle size of less than about 100 nm. In another embodiment, the filler has a particle size of about 50 nm or less, preferably about 30 nm or less. In an alternate embodiment, the filler has a micron particle size, e.g., about 5 microns to about 40 microns, preferably about 10 microns to about 30 microns.

The filler is preferably present in an amount of about 40 percent to about 90 percent of the MPC. In one embodiment, about 50 percent to about 85 percent of the MPC is the filler. In another embodiment, the filler is present in the MPC in an amount of about 60 percent to about 80 percent by weight of the MPC.

Interconnecting Pores

The pores preferably constitute about 35 percent or greater of the volume of the MPC. In one embodiment, the pores constitute about 35 percent to about 95 percent by volume of the MPC. In another embodiment, the pores contain about 60 percent or greater by volume of the MPC. As used herein, the porosity of the MPC is determined by the following equation:

$$\text{Porosity}=100*[1-d_1/d_2] \quad \text{Eq. 1}$$

Where $d_1$ is the density of the sample (determined from the sample weight and the sample volume obtained from sample dimensions) and $d_2$ is the density of the solid portion of the sample (determined from the sample weight and the volume of the solid portion of the sample).

The volume average diameter of the pores of the MPC may be determined by mercury porosimetry. Calculation of the volume average diameter of the MPC may thus be calculated as follows:

$$d=2[(v_1r_1/w_1)+(v_2r_2/w_2)]/[(v_1/w_1)+(v_2/w_2)] \quad \text{Eq. 2}$$

where $v_1$ is the total volume of the mercury intruded in the high pressure range, $v_2$ is the total volume of the mercury intruded in the low pressure range, $r_1$ is the volume average pore radius to be determined from the high pressure scan, $r_2$ is the volume average pore radius to be determined from the low pressure scan, $w_1$ is the weight of the sample subjected to a high pressure scan, and $w_2$ is the weight of the sample subjected to a low pressure scan.

In one embodiment, the volume average diameter of the pores is about 0.02 microns to about 50 microns. In another embodiment, volume average diameter of the pores is about 0.04 microns to about 40 microns. In yet another embodiment, the volume average diameter of the pores is about 0.05 microns to about 30 microns. In still another embodiment, the volume average diameter of the pores is about 0.02 microns to about 0.5 microns, preferably about 0.04 microns to about 0.3 microns, more preferably about 0.05 microns to about 0.25 microns.

Other Polymers

Other polymers may be present in the MPC as long as their presence does not materially affect the properties of the MPC in a negative manner. Suitable polymers for inclusion in the MPC include, but are not limited to, LDPE, HDPE, PTFE, polypropylene, copolymers of ethylene, copolymers of propylene, copolymers of ethylene and acrylic acid or methacrylic acid, and mixtures thereof. The carboxyl-containing copolymers may be partially or fully neutralized with metal ions.

As known to those of ordinary skill in the art, the amount of the other polymer(s) depends on the type of the polymer. For example, if the other polymer has a molecular structure with minimal branching, long sidechains, and bulky side groups, the other polymer may be incorporated into the MPC in a greater amount than if the other polymer had a large amount of branching, long sidechains, or bulky side groups. In one embodiment, the other polymer(s) is present in an amount of about 0 to about 30 percent. In another embodiment, the MPC includes about 1 percent to about 20 percent other polymer. In yet another embodiment, the other polymer is present in an amount of about 1 percent to about 15 percent. In still another embodiment, the MPC s substantially devoid of other polymer.

Additives

The compositions of the invention described above may also include various additives. For example, in addition to the above mentioned fillers, fillers may be added to the compositions of the invention to affect rheological and mixing properties, the specific gravity, i.e., density-modifying fillers, the modulus, the tear strength, reinforcement, and the like. The fillers are generally inorganic, and can be microparticles or nanoparticles. Suitable fillers include numerous metals, metal oxides and salts, such as zinc oxide and tin oxide, as well as barium sulfate, zinc sulfate, calcium oxide, calcium carbonate, zinc carbonate, barium carbonate, clay, tungsten, tungsten carbide, regrind (recycled core material typically ground to about 30 mesh particle), high-Mooney-viscosity rubber regrind, and mixtures thereof.

In one embodiment, the compositions of the invention can be reinforced by blending with a wide range of density-adjusting fillers, e.g., ceramics, glass spheres (solid or hollow, and filled or unfilled), and fibers, inorganic particles, and metal particles, such as metal flakes, metallic powders, oxides, and derivatives thereof, as is known to those with skill in the art. The selection of such filler(s) is dependent upon the type of golf ball desired, i.e., one-piece, two-piece, multi-component, or wound, as will be more fully detailed below. In another embodiment, the filler will be inorganic, having a density of greater than 4 g/cc, and will be present in amounts between about 5 and about 65 weight percent based on the total weight of the polymer composition.

The compositions of the invention may also be foamed by the addition of the at least one physical or chemical blowing or foaming agent. The use of a foamed polymer allows the golf ball designer to adjust the density or mass distribution of the ball to adjust the angular moment of inertia, and, thus, the spin rate and performance of the ball. Foamed materials also offer a potential cost savings due to the reduced use of polymeric material. As used herein, the term "foamed" encompasses "conventional foamed" materials that have cells with an average diameter of greater than 100 pm and "microcellular" type materials that have closed cell sizes on the order of 2 to 25 gym. Examples of conventional foamed materials include those described in U.S. Pat. No. 4,274,637. Examples of microcellular closed cell foams include those foams disclosed in U.S. Pat. No. 4,473,665 and U.S. Pat. No. 5,160,674. In this embodiment, the polymer blend may be foamed during molding by any conventional foaming or blowing agent. Preferably, foamed layers incorporating an oxa ester or oxa ester blend have a flexural modulus of at least about 1,000 psi to about 150,000 psi.

Blowing or foaming agents useful include, but are not limited to, organic blowing agents, such as azobisformamide; azobisisobutyronitrile; diazoaminobenzene; N,N-dimethyl-N,N-dinitroso terephthalamide; N,N-dinitrosopentamethylene-tetramine; benzenesulfonyl-hydrazide; benzene-1,3-disulfonyl hydrazide; diphenylsulfon-3-3, disulfonyl hydrazide; 4,4'-oxybis benzene sulfonyl hydrazide; p-toluene sulfonyl semicarbizide; barium azodicarboxylate; butylamine nitrile; nitroureas; trihydrazino triazine; phenylmethyl-uranthan; p-sulfonhydrazide; peroxides; and inorganic blowing agents such as ammonium bicarbonate and sodium bicarbonate. A gas, such as air, nitrogen, carbon dioxide, and the like, may also be injected into the composition during the injection molding process.

A foamed composition of the present invention may also be formed by blending microspheres with the composition either during or before the molding process. Polymeric, ceramic, metal, and glass microspheres are useful in the invention, and may be solid or hollow and filled or unfilled. In particular, microspheres up to about 1000 micrometers in diameter are useful. Generally, either injection molding or compression molding may be used to form a layer or a core including a foamed polymeric material.

Other materials conventionally included in golf ball compositions may also be added to the compositions of the invention. These additional materials include, but are not limited to, reaction enhancers, crosslinking agents, optical brighteners, coloring agents, fluorescent agents, whitening agents, UV absorbers, hindered amine light stabilizers, defoaming agents, processing aids, mica, talc, nano-fillers, and other conventional additives. Antioxidants, stabilizers, softening agents, plasticizers, including internal and external plasticizers, impact modifiers, foaming agents, excipients, organic extraction liquids, reinforcing materials and compatibilizers may also be added to any composition of the invention. In addition, heat stabilizers may be beneficial in enlarging the range of processing temperatures to greater than about 130° C. The plasticizer is preferably liquid at room temperature and usually is a processing oil such as paraffinic oil, naphthenic oil, or aromatic oil. Suitable organic extraction liquids depend on the material to be extracted, however, suitable examples include, but are not limited to, 1,1,2-trichloroethylene, perchloroethylene, 1,2-dichloroethane, 1,1,1-trichloroethane, 1,1,2-trichloroethane, methylene chloride, chloroform, 1,1,2-trichloro-1,2,2-trifluoroethane, isopropyl alcohol, diethyl ether, acetone, hexane, heptane, and toluene.

Although the present invention addresses prior art adhesion problems, additional adhesion promoters may also be of use in the present composition. Suitable adhesion promoters include, but are not limited to, silane-containing adhesion promoters and lubricants.

All of these materials, which are well known in the art, are added for their usual purpose in typical amounts. For example, the additive(s) is preferably present in an amount of about 15 percent or less. In one embodment, the additive is present in an amount of about 5 percent or less by weight of the MPC.

Adhesion

Adhesion may be measured in terms of peel strength using the T-Peel test (ASTM D-1876-72). The compositions of the invention preferably have a dry peel strength of about 0.5 pound per linear inch (pli) and a wet peel strength of about 0.25 pli. In one embodiment, the dry peel strength is about 1 pli or greater. In another embodiment, the dry peel strength is about 1.5 pli or greater. In yet another embodiment, the wet peel strength is about 0.5 pli or greater. In still another embodiment, the wet peel strength is about 1 pli or greater.

Methods of Forming

The MPC may be formed in a variety of ways. One such method is disclosed in U.S. Pat. No. 4,861,644. In addition, U.S. Pat. No. 3,351,495, the entire disclosure of which is incorporated by reference herein, discloses suitable methods for forming the MPCs of the present invention.

In general, the MPC may involve the extrusion of a continuous sheet to a calendar. After calendaring, the MPC is transferred to a first extraction zone where any processing plasticizer is removed with an organic solvent. Any suitable organic solvent may be used as long as the solvent does not also remove the polymer component. Additional extraction may be necessary, followed by drying, and ultimately the continuous MPC sheet is rolled for storage and shipping.

For example, as discussed in U.S. Pat. No. 6,114,023, the MPC maybe prepared by mixing together the polymer component, filler particles, processing plasticizer, and minor amounts of lubricant and antioxidant until a substantially uniform mixture is obtained. The mixture may then be introduced into the heated barrel of a screw extruder, which has a sheeting die attached thereto. A continuous sheet formed by the die is forwarded without drawing to a pair of heated calendar rolls acting cooperatively to form a continuous sheet of lesser thickness than the continuous sheet exiting the die. The calendared continuous sheet is then passed through a first extraction zone where the processing plasticizer is substantially removed by extraction with an organic liquid. The continuous sheet then passes to a second extraction zone to remove any residual organic liquid. A forced air dryer further removes any residual water or organic liquid. The continuous sheet is then rolled for storage and/or delivery.

Golf Ball Construction

The MPCs of the present invention may be used with any type of ball construction. For example, two-piece, three-piece, and four-piece golf ball designs are contemplated by the present invention. In addition, golf balls having double cores, intermediate layer(s), and/or double covers are also useful with the present invention. As known to those of ordinary skill in the art, the type of golf ball constructed, i.e., double core, double cover, and the like, depends on the type of performance desired of the ball. As used herein, the term "layer" includes any generally spherical portion of a golf ball, i.e., a golf ball core or center, an intermediate layer, and/or a golf ball cover. As used herein, the term "inner layer" refers to any golf ball layer beneath the outermost structural layer of the golf ball. As used herein, "structural layer" does not include a coating layer, top coat, paint layer, or the like. As used herein, the term "multilayer" means at least two layers.

Figure 2:
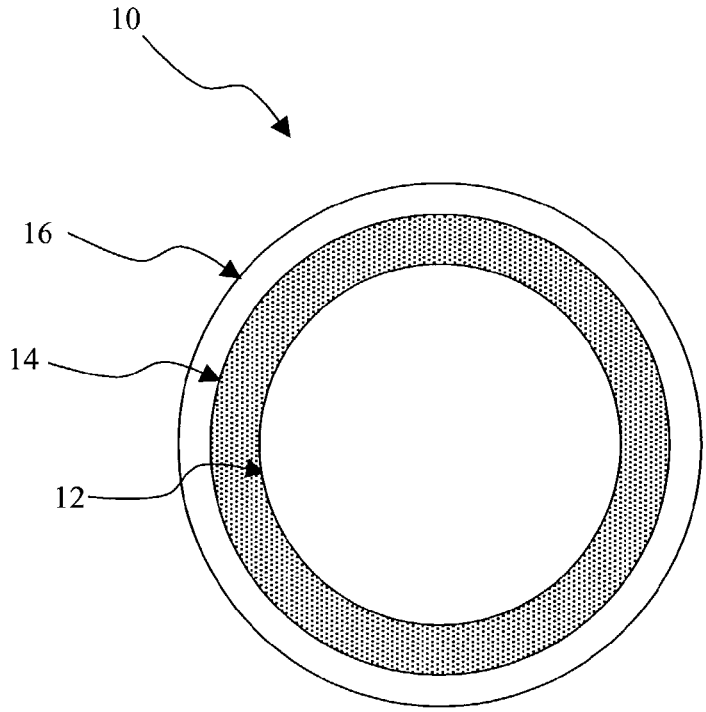
FIG. 2 is a cross-sectional view of a multi-component golf ball, wherein at least a portion of the golf ball is formed from the compositions of the invention.

In one embodiment, a golf ball 2 according to the invention (as shown in FIG. 1) includes a core 4 and a cover 6, wherein the at least one of core 4 and cover 6 incorporates at least one layer including the MPC of the invention. In one embodiment, the cover 6 includes an MPC of the present invention to facilitate printing/post-processing of the formed golf ball 2. Similarly, FIG. 2 illustrates a golf ball according to the invention incorporating an intermediate layer. Golf ball 10 includes a core 12, a cover 16, and an intermediate layer 14 disposed between the core 12 and cover 16. Any of the core 12, intermediate layer 14, or cover 16 may incorporate at least one layer that includes the MPC of the invention. In one embodiment, the intermediate layer 14 is formed of the MPC of the invention, which is then enclosed by a cover 16 formed of a thermoset or thermoplastic polyurethane or polyurea material. The MPC layer provides improved adhesion to the outer layer, thus eliminating the traditionally required surface treatments to increase adhesion.

Figure 3:
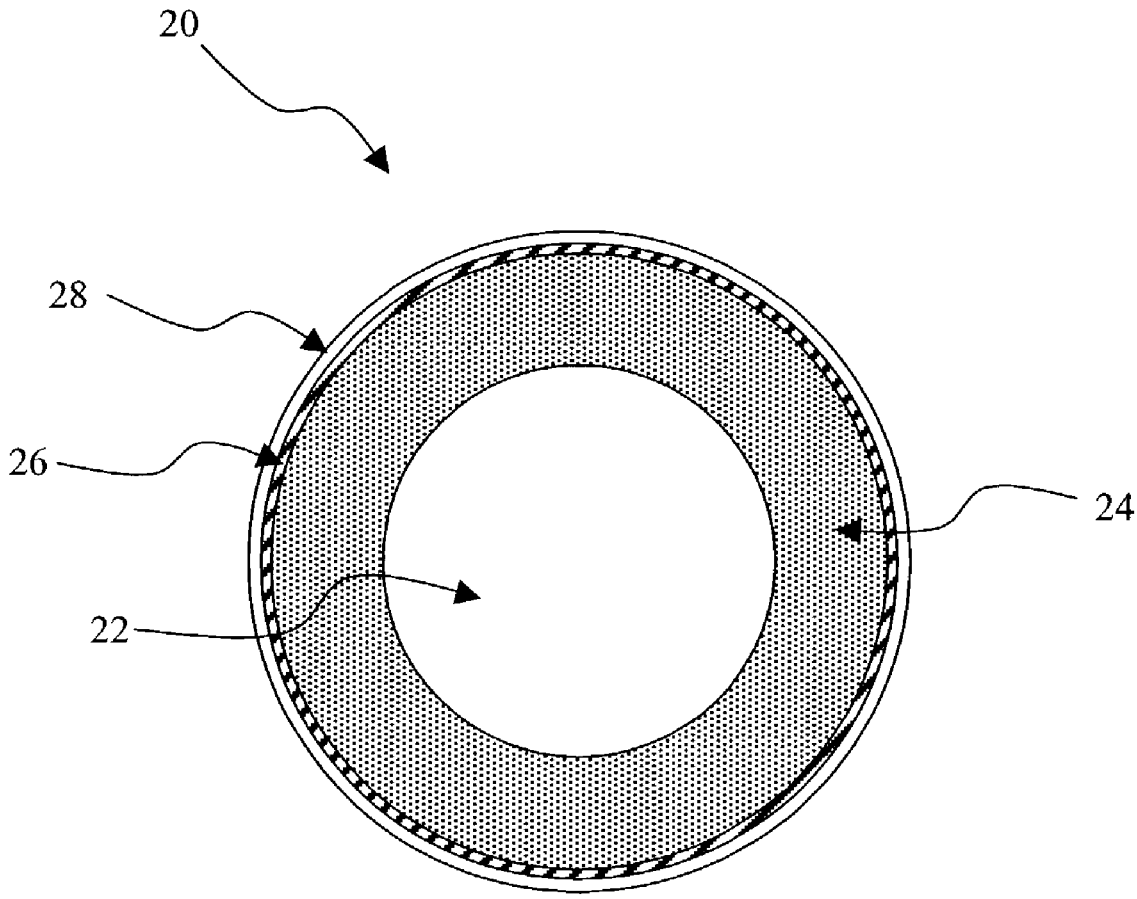
FIG. 3 is a cross-sectional view of a multi-component golf ball including a core, an outer core layer, a thin inner cover layer, and a thin outer cover layer disposed thereon, wherein at least a portion of the golf ball is formed from the compositions of the invention.

FIG. 3 illustrates a four-piece golf ball 20 according to the invention including a core 22, an outer core layer or intermediate layer 24, an inner cover layer or intermediate layer 26, and an outer cover layer 28. Any of the core 22, outer core or intermediate layer 24, or inner cover or intermediate layer 26 may include the MPCs of the invention. In one embodiment, the outer core layer 24 and the inner cover layer 26 are both formed of the MPCs of the invention, which is then enclosed by a thermoset or thermoplastic polyurethane or polyurea outer cover layer 28. In another embodiment, the composition of outer cover layer 28 also includes an MPC for improved printing and topcoating.

Other non-limiting examples of suitable types of ball constructions that may be used with the present invention include those described in U.S. Pat. Nos. 6,056,842, 5,688,191, 5,713,801, 5,803,831, 5,885,172, 5,919,100, 5,965,669, 5,981,654, 5,981,658, and 6,149,535, as well as in Publication Nos. US2001/0009310 A1, US2002/0025862, US2002/0028885, US2002/0151380. The entire disclosures of these patents and published patent applications are incorporated by reference herein. For example, in Publication No. US2002/015380, a golf ball having three or more cover layers is disclosed, of which any of the layers of the ball may be formed using the MPCs of the invention. In addition, the compositions of the invention are contemplated for use in the layers of the gradated hardness multilayer golf balls disclosed in U.S. patent application Ser. No. 09/767, 723, filed Jan. 24, 2001, entitled "Multi-Layer Golf Ball," which is incorporated by reference herein in its entirety.

As discussed, the golf balls of the invention include at least one layer that includes the MPCs of the invention. In addition, as discussed below, the golf balls of the invention may include core layers, intermediate layers, or cover layers formed from materials known to those of skill in the art. These examples are not exhaustive, as skilled artisans would be aware that a variety of materials might be used to produce a golf ball of the invention with desired performance properties.

Core Layer(s)

The cores of the golf balls formed according to the invention may be solid, semi-solid, hollow, fluid-filled, or powder filled. As used herein, the term "core" means the innermost portion of a golf ball, and may include one or more layers. For example, U.S. Pat. Nos. 6,180,040 and 6,180,722 disclose methods of preparing dual core golf balls. The entire disclosures of these patents are incorporated by reference herein. The term "semi-solid" as used herein refers to a paste, a gel, or the like. The cores of the golf balls of the invention may be spherical, cubical, pyramid-shaped, geodesic, or any three-dimensional, symmetrical shape.

While the cores of the invention may be formed with the MPCs of the invention, conventional materials may also be used to form the cores. Suitable core materials include, but are not limited to, thermoset materials, such as rubber, styrene butadiene, polybutadiene, isoprene, polyisoprene, trans-isoprene, and polyurethane, and thermoplastic materials, such as conventional ionomer resins, polyamides, polyesters, and polyurethane. In one embodiment, at least one layer of the core is formed from a polybutadiene reaction product, such as the reaction products disclosed in co-pending U.S. patent application Ser. No. 10/190,705, entitled, "Low Compression, Resilient Golf Balls With Rubber Core," filed Jul. 9, 2002, the entire disclosure of which is incorporated by reference herein.

Additional materials may be included in the core layer compositions outlined above. For example, catalysts, coloring agents, optical brighteners, crosslinking agents, whitening agents such as $TiO_2$ and ZnO, UV absorbers, hindered amine light stabilizers, defoaming agents, processing aids, surfactants, and other conventional additives may be added to the core layer compositions of the invention. In addition, antioxidants, stabilizers, softening agents, plasticizers, including internal and external plasticizers, impact modifiers, foaming agents, density-adjusting fillers, reinforcing materials, and compatibilizers may also be added to any of the core layer compositions. One of ordinary skill in the art should be aware of the requisite amount for each type of additive to realize the benefits of that particular additive.

The core may also include one or more wound layers (surrounding a fluid or solid center) including at least one tensioned elastomeric material wound about the center. In one embodiment, the tensioned elastomeric material includes natural or synthetic elastomers or blends thereof. The synthetic elastomer preferably includes LYCRA. In another embodiment, the tensioned elastomeric material incorporates a polybutadiene reaction product as disclosed in co-pending U.S. patent application Ser. No. 10/190,705. In yet another embodiment, the tensioned elastomeric material may also be formed from conventional polyisoprene. In still another embodiment, a polyurea composition (as disclosed in co-pending U.S. patent application Ser. No. 10/228,311, filed Aug. 27, 2002, entitled "Golf Balls Comprising Light Stable Materials and Methods for Making Same," which is incorporated by reference in its entirety by reference herein) is used to form the tensioned elastomeric material. In another embodiment, solvent spun polyethers urea, as disclosed in U.S. Pat. No. 6,149,535, is used to form the tensioned elastomeric material in an effort to achieve a smaller cross-sectional area with multiple strands. The entire disclosures of these patent applications and issued patents are incorporated by reference herein.

The tensioned elastomeric layer may also be a high tensile filament having a tensile modulus of about 10,000 kpsi or greater, as disclosed in co-pending U.S. patent application Ser. Nos. 09/842,829 and 09/841,910, filed Apr. 27, 2001, entitled "All Rubber Golf Ball with Hoop-Stress Layer" and "MultiLayer Golf Ball With Hoop-Stress Layer," respectively, the entire disclosures of which are incorporated by reference herein.

In another aspect of the invention, the golf balls of the invention include a thin, highly filled layer, such as the ones disclosed in U.S. Pat. No. 6,494,795, which is incorporated by reference herein in its entirety. A thin, highly filled core layer allows the weight or mass of the golf ball to be allocated radially relative to the centroid, thereby dictating the moment of inertia of the ball. When the weight is allocated radially toward the centroid, the moment of inertia is decreased, and when the weight is allocated outward away from the centroid, the moment of inertia is increased.

For example, a low moment of inertia ball can be formed using a high specific gravity core layer encompassed by a low specific gravity layer. The low specific gravity layer may be formed using a density reducing filler or by some other means, e.g., by foaming. In this aspect of the invention, the core layer may have the highest specific gravity of all the layers in the golf ball. In one embodiment, the specific gravity of the core layer is greater than about 1.8, preferably greater than about 2.0, and more preferably greater than about 2.5. In another embodiment, the specific gravity of the core layer is about 5 or greater. In yet another embodiment, the specific gravity of the core layer is about 10 or greater.

In one embodiment, the highly filled layer is the center of the ball or the outer core layer, or both. This high specific gravity core layer may be formed from the radiation-curable compositions of the invention, which include the appropriate fillers to raise the specific gravity to the requisite amount. Alternatively, the highly filled core layer may be made from a high density metal or from metal powder encased in a polymeric binder. High density metals such as steel, tungsten, lead, brass, bronze, copper, nickel, molybdenum, or alloys may be used.

Intermediate Layer(s)

As used herein, "intermediate layer" includes any layer between the innermost layer of the golf ball and the outermost layer of the golf ball. Therefore, intermediate layers may also be referred to as outer core layers, inner cover layers, and the like. When the golf ball of the present invention includes an intermediate layer, this layer may include any materials known to those of ordinary skill in the art, including various thermoset and thermoplastic materials, as well as blends thereof. For example, the intermediate layers of the golf ball of the invention may be formed with the MPCs of the invention. The intermediate layer may likewise be formed, at least in part, from one or more homopolymeric or copolymeric materials, such as vinyl resins, polyolefins, polyurethanes, polyureas, polyamides, acrylic resins, olefinic thermoplastic rubbers, block copolymers of styrene and butadiene, isoprene or ethylene-butylene rubber, copoly(ether-amide), polyphenylene oxide resins, thermoplastic polyesters, ethylene, propylene, 1-butene or 1-hexene based homopolymers or copolymers, and the like.

The intermediate layer may also be formed from highly neutralized polymers such as those disclosed U.S. Patent Publication No. 2001/0018375 and 2001/0019971, which are incorporated herein in their entirety by express reference thereto; grafted and non-grafted metallocene catalyzed polyolefins and polyamides, polyamide/ionomer blends, and polyamide/nonionomer blends, such as those disclosed in U.S. patent application Ser. No. 10/138,304, filed May 6, 2002, entitled "Golf Ball Incorporating Grafted Metallocene Catalyzed Polymer Blends," which is incorporated by reference herein in its entirety; among other polymers. Examples of other suitable intermediate layer materials include blends of some of the above materials, such as those disclosed in U.S. Pat. No. 5,688,181, the entire disclosure of which is incorporated by reference herein.

Additional materials may be included in the intermediate layer compositions outlined above. For example, catalysts, coloring agents, optical brighteners, crosslinking agents, whitening agents such as $TiO_2$ and ZnO, UV absorbers, hindered amine light stabilizers, defoaming agents, processing aids, surfactants, and other conventional additives may be added to the intermediate layer compositions of the invention. In addition, antioxidants, stabilizers, softening agents, plasticizers, including internal and external plasticizers, impact modifiers, foaming agents, density-adjusting fillers, reinforcing materials, and compatibilizers may also be added to any of the intermediate layer compositions. One of ordinary skill in the art should be aware of the requisite amount for each type of additive to realize the benefits of that particular additive.

The intermediate layer may also be formed of a binding material and an interstitial material distributed in the binding material, as discussed in U.S. patent application Ser. No. 10/028,826, filed Dec. 28, 2001, entitled, "Golf Ball with a Radially Oriented Transversely Isotropic Layer and Manufacture of Same," the entire disclosure of which is incorporated by reference herein. In addition, at least one intermediate layer may also be a moisture barrier layer, such as the ones described in U.S. Pat. No. 5,820,488, which is incorporated in its entirety by reference herein. The intermediate layer may also be formed from any of the polyurethane, polyurea, and polybutadiene materials discussed co-pending U.S. patent application Ser. No. 10/228,311.

Cover Layer(s)

The cover provides the interface between the ball and a club. As used herein, the term "cover" means the outermost portion of a golf ball. A cover typically includes at least one layer and may contain indentations such as dimples and/or ridges. Paints and/or laminates are typically disposed about the cover to protect the golf ball during use thereof. The cover may include a plurality of layers, e.g., an inner cover layer disposed about a golf ball center and an outer cover layer formed thereon.

The cover layers may be formed of the MPCs of the invention. For example, when the outer cover is formed with an MPC, the painting or printing thereon is facilitated. In particular, the MPCs of the present invention enable enhanced imaging during printing, i.e., a sharper image, because the MPC layer accept a broad range of printing applications and coating materials due to the mechanical locking potential of the porous network.

Alternatively, the inner and/or outer cover layers of golf balls of the present invention may be formed of the ionomer compositions (partially, highly, or fully neutralized), other cover materials known to those of skill in the art, or blends thereof. For example, the cover may be formed of polyurea, polyurethane, or mixtures thereof, as disclosed in co-pending U.S. patent application Ser. No. 10/228,311, filed Aug. 27, 2002, entitled "Golf Balls Comprising Light Stable Materials and Methods of Making Same," and Ser. No. 10/339,603, filed Jan. 10, 2003, entitled "Polyurethane Compositions for Golf Balls." The entire disclosures of these applications are incorporated by reference herein.

In addition, cover layers may also be formed of one or more homopolymeric or copolymeric materials, such as vinyl resins, polyolefins, conventional polyurethanes and polyureas, such as the ones disclosed in U.S. Pat. Nos. 5,334,673, and 5,484,870, polyamides, acrylic resins and blends of these resins with poly vinyl chloride, elastomers, and the like, thermoplastic urethanes, olefinic thermplastic rubbers, block copolymers of styrene and butadiene, polyphenylene oxide resins or blends of polyphenylene oxide with high impact polystyrene, thermoplastic polyesters, ethylene, propylene, 1-butene or 1-hexane based homopolymers or copolymers including functional monomers, methyl acrylate, methyl methacrylate homopolymers and copolymers, low acid ionomers, high acid ionomers, alloys, and mixtures thereof. The cover may also be at least partially formed from a polybutadiene reaction product.

Additional materials may be included in the cover layer compositions outlined above. For example, catalysts, coloring agents, optical brighteners, crosslinking agents, whitening agents such as $TiO_2$ and ZnO, UV absorbers, hindered amine light stabilizers, defoaming agents, processing aids, surfactants, and other conventional additives may be added to the cover layer compositions of the invention. In addition, antioxidants, stabilizers, softening agents, plasticizers, including internal and external plasticizers, impact modifiers, foaming agents, density-adjusting fillers, reinforcing materials, and compatibilizers may also be added to any of the cover layer compositions. Those of ordinary skill in the art should be aware of the requisite amount for each type of additive to realize the benefits of that particular additive.

Furthermore, while hardness gradients are typically used in a golf ball to achieve certain characteristics, the present invention also contemplates the compositions of the invention being used in a golf ball with multiple cover layers having essentially the same hardness, wherein at least one of the layers has been modified in some way to alter a property that affects the performance of the ball. Such ball constructions are disclosed in co-pending U.S. patent application Ser. No. 10/167,744, filed Jun. 13, 2002, entitled "Golf Ball with Multiple Cover Layers," the entire disclosure of which is incorporated by reference herein.

As discussed above with respect to the core of the golf balls of the invention, the use of a thin, highly filled layer allows the weight or mass of the golf ball to be allocated radially relative to the centroid, thereby dictating the moment of inertia of the ball. This concept is translatable to the cover layers of a golf ball. Thus, the inner cover layer may be a thin, dense layer so as to form a high moment of inertia ball. In this aspect of the invention, the inner cover layer preferably has a specific gravity of greater than 1.2, more preferably more than 1.5, even more preferably more than 1.8, and most preferably more than 2.0. Suitable materials for the thin, dense layer include any material that meets the specific gravity stated above. For example, this thin, highly filled inner cover layer may be formed of the radiation-curable compositions of the invention, adjusting for the requisite specific gravity. Alternatively, the inner cover layer may be formed from epoxies, styrenated polyesters, polyurethanes or polyureas, liquid PBR's, silicones, silicate gels, agar gels, and the like.

Methods for Forming

The golf balls of the invention may be formed using a variety of application techniques such as compression molding, flip molding, injection molding, retractable pin injection molding, reaction injection molding (RIM), liquid injection molding (LIM), casting, vacuum forming, powder coating, flow coating, spin coating, dipping, spraying, and the like. A method of injection molding using a split vent pin can be found in co-pending U.S. patent application Ser. No. 09/742,435, filed Dec. 22, 2000, entitled "Split Vent Pin for Injection Molding." Examples of retractable pin injection molding may be found in U.S. Pat. Nos. 6,129,881, 6,235,230, and 6,379,138. These molding references are incorporated in their entirety by reference herein. In addition, a chilled chamber, i.e., a cooling jacket, such as the one disclosed in U.S. patent application Ser. No. 09/717,136, filed Nov. 22, 2000, entitled "Method of Making Golf Balls" may be used to cool the compositions of the invention when casting, which also allows for a higher loading of catalyst into the system.

One skilled in the art would appreciate that the molding method used may be determined at least partially by the properties of the composition. For example, casting, RIM, or LIM may be preferred when the material is thermoset, whereas compression molding or injection molding may be preferred for thermoplastic compositions. Compression molding, however, may also be used for thermoset inner ball materials. For example, when cores are formed from a thermoset material, compression molding is a particularly suitable method of forming the core, whereas when the cores are formed of a thermoplastic material, the cores may be injection molded. In addition, the intermediate layer may also be formed from using any suitable method known to those of ordinary skill in the art. For example, an intermediate layer may be formed by blow molding and covered with a dimpled cover layer formed by injection molding, compression molding, casting, vacuum forming, powder coating, and the like.

The MPCs of the present invention may be formed into the intended golf ball layer(s) in a variety of ways, as long as the MPC retains its useful properties throughout the molding process. For example, a mixture containing the MPC ingredients may be used to mold a layer of the golf ball, which would typically be followed by an extraction process to remove the processing aids. Another method of forming an MPC layer may involve the use of preformed MPC sheets as described above. For example, the finished sheet of MPC may be compression molded in half shells and then molded over an inner ball to form a layer. Injection molding of MPCs is also contemplated by the present invention, wherein the MPC is pre-formed and pelletized for use in injection molding of a layer of the golf ball without losing its beneficial properties.

When an inner layer is formed of an MPC of the invention, the inner layer may be formed using a staged resin film concept, which is an alternative to casting or injection molding and permits ball designs with more specific weight distribution and alterations in moisture transmission. Methods of forming a staged resin film are disclosed in co-pending U.S. patent application Ser. No. 09/923,071, filed Aug. 6, 2001, entitled "Golf Balls Including a Staged Resin Film and Methods of Making Same," which is incorporated in its entirety by reference herein.

In addition, when covers for the golf balls of the invention are formed of polyurea and/or polyurethane compositions, these materials may be applied over an inner ball using a variety of application techniques such as spraying, compression molding, dipping, spin coating, casting, or flow coating methods that are well known in the art. Examples of forming polyurea and polyurethane materials about an inner ball are disclosed in U.S. Pat. Nos. 5,733,428, 5,006,297, and 5,334,673, which are incorporated by reference in their entirety herein. In one embodiment, a combination of casting and compression molding can be used to form a polyurethane or polyurea composition over an inner ball. However, the method of forming covers according to the invention is not limited to the use of these techniques; other methods known to those skilled in the art may also be employed.

While the MPCs of the invention improve adhesion between layers, prior to forming the cover layer, the inner ball, i.e., the core and any intermediate layers disposed thereon, may be surface treated to further increase the adhesion between the outer surface of the inner ball and the cover. Examples of such surface treatment may include mechanically or chemically abrading the outer surface of the subassembly. Additionally, the inner ball may be subjected to corona discharge, plasma treatment, and/or silane dipping prior to forming the cover around it. Other layers of the ball, e.g., the core, also may be surface treated. Examples of these and other surface treatment techniques can be found in U.S. Pat. No. 6,315,915, which is incorporated by reference in its entirety.

The methods discussed herein and other manufacturing methods for forming the golf ball components of the present invention are also disclosed in U.S. Pat. Nos. 6,207,784 and 5,484,870, the disclosures of which are incorporated herein by reference in their entirety.

Dimples

The golf balls of the invention are prefereably designed with certain flight characteristics in mind. The use of various dimple patterns and profiles provides a relatively effective way to modify the aerodynamic characteristics of a golf ball. As such, the manner in which the dimples are arranged on the surface of the ball can be by any available method. For instance, the ball may have an icosahedron-based pattern, such as described in U.S. Pat. No. 4,560,168, or an octahedral-based dimple patterns as described in U.S. Pat. No. 4,960,281. Alternatively, the dimple pattern can be arranged according to phyllotactic patterns, such as described in U.S. Pat. No. 6,338,684, which is incorporated herein in its entirety.

Dimple patterns may also be based on Archimedean patterns including a truncated octahedron, a great rhombcuboctahedron, a truncated dodecahedron, and a great rhombicosidodecahedron, wherein the pattern has a non-linear parting line, as disclosed in U.S. patent application Ser. No. 10/078,417, which is incorporated in its entirety by reference herein. The golf balls of the present invention may also be covered with non-circular shaped dimples, i.e., amorphous shaped dimples, as disclosed in U.S. Pat. No. 6,409,615, which is incorporated in its entirety by reference herein.

Dimple patterns that provide a high percentage of surface coverage are preferred, and are well known in the art. For example, U.S. Pat. Nos. 5,562,552, 5,575,477, 5,957,787, 5,249,804, and 4,925,193 disclose geometric patterns for positioning dimples on a golf ball. In one embodiment, the golf balls of the invention have a dimple coverage of the surface area of the cover of at least about 60 percent, preferably at least about 65 percent, and more preferably at least 70 percent or greater. Dimple patterns having even higher dimple coverage values may also be used with the present invention. Thus, the golf balls of the present invention may have a dimple coverage of at least about 75 percent or greater, about 80 percent or greater, or even about 85 percent or greater.

In addition, a tubular lattice pattern, such as the one disclosed in U.S. Pat. No. 6,290,615, which is incorporated by reference in its entirety herein, may also be used with golf balls of the present invention. The golf balls of the present invention may also have a plurality of pyramidal projections disposed on the intermediate layer of the ball, as disclosed in U.S. Pat. No. 6,383,092, which is incorporated in its entirety by reference herein. The plurality of pyramidal projections on the golf ball may cover between about 20 percent to about 80 of the surface of the intermediate layer.

In an alternative embodiment, the golf ball may have a non-planar parting line allowing for some of the plurality of pyramidal projections to be disposed about the equator. Such a golf ball may be fabricated using a mold as disclosed in U.S. patent application Ser. No. 09/442,845, filed Nov. 18, 1999, entitled "Mold For A Golf Ball," and which is incorporated in its entirety by reference herein. This embodiment allows for greater uniformity of the pyramidal projections. Several additional non-limiting examples of dimple patterns with varying sizes of dimples are also provided in U.S. Pat. Nos. 6,358,161 and 6,213,898, the entire disclosures of which are incorporated by reference herein.

The total number of dimples on the ball, or dimple count, may vary depending such factors as the sizes of the dimples and the pattern selected. In general, the total number of dimples on the ball preferably is between about 100 to about 1000 dimples, although one skilled in the art would recognize that differing dimple counts within this range can significantly alter the flight performance of the ball. In one embodiment, the dimple count is about 380 dimples or greater, but more preferably is about 400 dimples or greater, and even more preferably is about 420 dimples or greater. In one embodiment, the dimple count on the ball is about 422 dimples. In some cases, it may be desirable to have fewer dimples on the ball. Thus, one embodiment of the present invention has a dimple count of about 380 dimples or less, and more preferably is about 350 dimples or less.

Dimple profiles revolving a catenary curve about its symmetrical axis may increase aerodynamic efficiency, provide a convenient way to alter the dimples to adjust ball performance without changing the dimple pattern, and result in uniformly increased flight distance for golfers of all swing speeds. Thus, catenary curve dimple profiles, as disclosed in U.S. Patent application Ser. No. 09/989,191, filed Nov. 21, 2001, entitled "Golf Ball Dimples with a Catenary Curve Profile," which is incorporated in its entirety by reference herein, is contemplated for use with the golf balls of the present invention.

Golf Ball Post-Processing

The golf balls of the present invention may be painted, coated, or surface treated for further benefits. For example, a golf ball of the invention may be treated with a base resin paint composition or the cover composition may contain certain additives to achieve a desired color characteristic. In one embodiment, the golf ball cover composition contains a fluorescent whitening agent, e.g., a derivative of 7-triazinylamino-3-phenylcoumarin, to provide improved weather resistance and brightness. An example of such a fluorescent whitening agent is disclosed in U.S. Patent Publication No. 2002/0082358, which is incorporated by reference herein in its entirety.

Protective and decorative coating materials, as well as methods of applying such materials to the surface of a golf ball cover are well known in the golf ball art. Generally, such coating materials comprise urethanes, urethane hybrids, epoxies, polyesters and acrylics. In one embodiment, however, the coating may contain an MPC of the invention.

The coating layer(s) may be applied by any suitable method known to those of ordinary skill in the art. For example, the coating layer(s) may be applied to the golf ball cover by an in-mold coating process, such as described in U.S. Pat. No. 5,849,168, which is incorporated in its entirety by reference herein. In addition, the golf balls of the invention may be painted or coated with an ultraviolet curable/treatable ink, by using the methods and materials disclosed in U.S. Pat. Nos. 6,500,495, 6,248,804, and 6,099,415, the entire disclosures of which are incorporated by reference herein.

Any trademarks or other indicia that may be used with the present inveniton may be applied to the ball through a variety of methods known to those of skill in the golf ball manufacturing art. In fact, the present invention advantangeously enlarges the scope of printing applications that may be used on outer cover layers of golf balls because of the mechanical locking potential of the porous netwrok of the MPCs. In one embodiment, the indicia is stamped, i.e., pad-printed, on the outer surface of the ball cover, and the stamped outer surface is then treated with at least one clear coat to give the ball a glossy finish and protect the indicia stamped on the cover. In another embodiment, the indicia is applied to the intended layer by ink-jet printing. And, if desired, more than one coating layer can be used, which may include the MPCs of the invention and/or conventional coating materials. For example, in one embodiment, a golf ball of the invention may be coated with a thin layer of MPC, subjected to further processing, and coated again. The additional coating layer may be an MPC or conventional coating.

In addition, the sharpness of the printed image is greatly improved, especially for ink-jet printing applications, because of the microporosity of the MPC. The quality of printed images may be assessed in a variety of ways. For example, to determine the quality of the MPC substrate for printing applications, a halftone image, comprised of a series of dots, may be used, with a microscope, to evaluate the coverage and resolution of dots in the image. Using this evaluation method, the image preferably contains well shaped and covered dots with sizes of about 0.1 mm or less. In another embodiment, the dot sizes of the halftone images are about 0.08 mm or less. A similar method may be used with ink-jet printing. For example, the dots making up the image may be examined for resolution, however, because the dot sizes with ink-jet printing are typically larger than with offset printing of a halftone image, the diameters will be larger than discussed above. Regardless, the dots may be examined to determine whether each dot is a separate image from the next dot and whether each dot is relatively circular in outline. Lack of splatter or bleed is also good evidence of high resolution.

Furthermore, the MPCs of the present invention allow for accelerated drying times. Thus, when an MPC golf ball layer is coated or printed upon, the drying time of the ink, paint, or clear-coat is preferably about 90 percent or less of conventional drying times. In one embodiment, the drying time is about 80 percent or less of conventional drying times. In another embodiment, the drying time is about 70 percent or less of conventional drying times. This accelerated drying time advantageously provides a tack free-state for further processing or packaging. In addition, production is more efficient because less balls are rejected for wet transfer problems, offset problems, and the like.

Because the MPCs of the present invention are much easier to print upon and the images are much clearer once printed upon an MPC, the present invention contemplates indicia on all golf ball layers. For example, whereas a conventional core or inner layer composition may not have been easily printed upon in the past, a core or inner layer formed of, at least in part, an MPC of the invention, may readily accept the printed indicia. This advantageously allows for a tracking system to be employed for the inner and outer components of the golf ball. Methods of tracking may be useful for golf ball manufacturers to track a particular golf ball component through production or over the lifetime of the ball. Many golf ball manufacturers currently use a lettered or numbered marking situated in various dimples of a golf ball outer cover for identification purposes. The markings protrude slightly from the surface and to the untrained eye, may look as if the outer cover has imperfections. An MPC layer allows printing on inner components of the golf ball, as well as the cover, advantageously allowing for a visible and understandable tracking system for all components of a golf ball, both during production and throughout the useful life of the golf ball. The indicia may also be altered slightly for each component allowing identification of the specific golf ball as well as the specific component of the golf ball.

Furthermore, this indicia tracking system could be helpful to deter golf ball refurbishers from recovering a certain manufacturer's golf ball to claim as their own. For example, an inner golf ball component made of an MPC of the invention may be printed upon with an identifying indicia, by traditional ink-jet printing, pad printing, dye sublimation, such as disclosed in U.S. patent application Ser. No. 10/012,538, filed Dec. 12, 2001, entitled, "Method of Forming Indicia on a Golf Ball," the entire disclosure of which is incorporated by reference herein, infrared dye marking, fluorescent marking, phosphorescent marking, radioopaque marking, or the like. A golf ball manufacturer would then be able to discern whether the refurbished golf ball contained the marker through a variety of methods depending on the marking. If the MPC includes, for example, a radioopaque marker, the manufactuer would be able to discern the marking through the use of fluoroscopic or other x-ray imaging modalities. Thus, in one embodiment, the inner components of a golf ball, e.g., the core or intermediate layers, as well as the outer components, may be tracked using an indicia, or other identifying mark, e.g., a bar code, which is printed upon the MPC layer.

Laser marking of a selected surface portion of a golf ball causing the laser light-irradiated portion to change color is also contemplated for use with the present invention. U.S. Pat. Nos. 5,248,878 and 6,075,223 generally disclose such methods, the entire disclosures of which are incorporated by reference herein. In addition, the golf balls may be subjected to ablation, i.e., directing a beam of laser radiation onto a portion of the cover, irradiating the cover portion, wherein the irradiated cover portion is ablated to form a detectable mark, wherein no significant discoloration of the cover portion results therefrom. Ablation is discussed in U.S. Pat. No. 6,462,303, which is incorporated in its entirety by reference herein. These methods of marking may be used with an MPC layer of the present invention or a layer formed of conventional golf ball materials.

Golf Ball Properties

The properties such as hardness, modulus, core diameter, intermediate layer thickness and cover layer thickness of the golf balls of the present invention have been found to effect play characteristics such as spin, initial velocity and feel of the present golf balls. For example, the flexural and/or tensile modulus of the intermediate layer are believed to have an effect on the "feel" of the golf balls of the present invention. It should be understood that the ranges herein are meant to be intermixed with each other, i.e., the low end of one range may be combined with a high end of another range.

Component Dimensions

Dimensions of golf ball components, i.e., thickness and diameter, may vary depending on the desired properties. For the purposes of the invention, any layer thickness may be employed. Non-limiting examples of the various embodiments outlined above are provided here with respect to layer dimensions.

The present invention relates to golf balls of any size. While USGA specifications limit the size of a competition golf ball to more than 1.68 inches in diameter, golf balls of any size can be used for leisure golf play. The preferred diameter of the golf balls is from about 1.68 inches to about 1.8 inches. The more preferred diameter is from about 1.68 inches to about 1.76 inches. A diameter of from about 1.68 inches to about 1.74 inches is most preferred, however diameters anywhere in the range of from 1.7 to about 1.95 inches can be used. Preferably, the overall diameter of the core and all intermediate layers is about 80 percent to about 98 percent of the overall diameter of the finished ball.

The core may have a diameter ranging from about 0.09 inches to about 1.65 inches. In one embodiment, the diameter of the core of the present invention is about 1.2 inches to about 1.630 inches. In another embodiment, the diameter of the core is about 1.3 inches to about 1.6 inches, preferably from about 1.39 inches to about 1.6 inches, and more preferably from about 1.5 inches to about 1.6 inches. In yet another embodiment, the core has a diameter of about 1.55 inches to about 1.65 inches.

The core of the golf ball may also be extremely large in relation to the rest of the ball. For example, in one embodiment, the core makes up about 90 percent to about 98 percent of the ball, preferably about 94 percent to about 96 percent of the ball. In this embodiment, the diameter of the core is preferably about 1.54 inches or greater, preferably about 1.55 inches or greater. In one embodiment, the core diameter is about 1.59 inches or greater. In another embodiment, the diameter of the core is about 1.64 inches or less.

When the core includes an inner core layer and an outer core layer, the inner core layer is preferably about 0.9 inches or greater and the outer core layer preferably has a thickness of about 0.1 inches or greater. In one embodiment, the inner core layer has a diameter from about 0.09 inches to about 1.2 inches and the outer core layer has a thickness from about 0.1 inches to about 0.8 inches. In yet another embodiment, the inner core layer diameter is from about 0.095 inches to about 1.1 inches and the outer core layer has a thickness of about 0.20 inches to about 0.03 inches.

If the composition of the invention is used as an outer core layer, the cured thickness of the layer is preferably about 0.001 inches to about 0.1 inches. In one embodiment, the outer core layer's cured thickness is about 0.002 inches to about 0.05 inches. In another embodiment, the cured thickness of the outer core layer is about 0.003 inches to about 0.03 inches.

The cover typically has a thickness to provide sufficient strength, good performance characteristics, and durability. In one embodiment, the cover thickness is from about 0.02 inches to about 0.35 inches. In another embodiment, the cover preferably has a thickness of about 0.02 inches to about 0.12 inches, preferably about 0.1 inches or less, more preferably about 0.07 inches or less. In yet another embodiment, the outer cover has a thickness from about 0.02 inches to about 0.07 inches. In still another embodiment, the cover thickness is about 0.05 inches or less, preferably from about 0.02 inches to about 0.05 inches. For example, the outer cover layer may be between about 0.02 inches and about 0.045 inches, preferably about 0.025 inches to about 0.04 inches thick. In one embodiment, the outer cover layer is about 0.03 inches thick.

The range of thicknesses for an intermediate layer of a golf ball is large because of the vast possibilities when using an intermediate layer, i.e., as an outer core layer, an inner cover layer, a wound layer, a moisture/vapor barrier layer. When used in a golf ball of the invention, the intermediate layer, or inner cover layer, may have a thickness about 0.3 inches or less. In one embodiment, the thickness of the intermediate layer is from about 0.002 inches to about 0.1 inches, preferably about 0.01 inches or greater. In one embodiment, the thickness of the intermediate layer is about 0.09 inches or less, preferably about 0.06 inches or less. In another embodiment, the intermediate layer thickness is about 0.05 inches or less, more preferably about 0.01 inches to about 0.045 inches. In one embodiment, the intermediate layer, thickness is about 0.02 inches to about 0.04 inches. In another embodiment, the intermediate layer thickness is from about 0.025 inches to about 0.035 inches. In yet another embodiment, the thickness of the intermediate layer is about 0.035 inches thick. In still another embodiment, the inner cover layer is from about 0.03 inches to about 0.035 inches thick. Varying combinations of these ranges of thickness for the intermediate and outer cover layers may be used in combination with other embodiments described herein.

The ratio of the thickness of the intermediate layer to the outer cover layer is preferably about 10 or less, preferably from about 3 or less. In another embodiment, the ratio of the thickness of the intermediate layer to the outer cover layer is about 1 or less. The core and intermediate layer(s) together form an inner ball preferably having a diameter of about 1.48 inches or greater for a 1.68-inch ball. In one embodiment, the inner ball of a 1.68-inch ball has a diameter of about 1.52 inches or greater. In another embodiment, the inner ball of a 1.68-inch ball has a diameter of about 1.66 inches or less. In yet another embodiment, a 1.72-inch (or more) ball has an inner ball diameter of about 1.50 inches or greater. In still another embodiment, the diameter of the inner ball for a 1.72-inch ball is about 1.70 inches or less.

Hardness

Most golf balls consist of layers having different hardnesses, e.g., hardness gradients, to achieve desired performance characteristics. The present invention contemplates golf balls having hardness gradients between layers, as well as those golf balls with layers having the same hardness.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

The cores of the present invention may have varying hardnesses depending on the particular golf ball construction. In one embodiment, the core hardness is at least about 15 Shore A, preferably about 30 Shore A, as measured on a formed sphere. In another embodiment, the core has a hardness of about 50 Shore A to about 90 Shore D. In yet another embodiment, the hardness of the core is about 80 Shore D or less. Preferably, the core has a hardness about 30 to about 65 Shore D, and more preferably, the core has a hardness about 35 to about 60 Shore D.

The intermediate layer(s) of the present invention may also vary in hardness depending on the specific construction of the ball. In one embodiment, the hardness of the intermediate layer is about 30 Shore D or greater. In another embodiment, the hardness of the intermediate layer is about 90 Shore D or less, preferably about 80 Shore D or less, and more preferably about 70 Shore D or less. In yet another embodiment, the hardness of the intermediate layer is about 50 Shore D or greater, preferably about 55 Shore D or greater. In one embodiment, the intermediate layer hardness is from about 55 Shore D to about 65 Shore D. The intermediate layer may also be about 65 Shore D or greater.

When the intermediate layer is intended to be harder than the core layer, the ratio of the intermediate layer hardness to the core hardness preferably about 2 or less. In one embodiment, the ratio is about 1.8 or less. In yet another embodiment, the ratio is about 1.3 or less.

As with the core and intermediate layers, the cover hardness may vary depending on the construction and desired characteristics of the golf ball. The ratio of cover hardness to inner ball hardness is a primary variable used to control the aerodynamics of a ball and, in particular, the spin of a ball. In general, the harder the inner ball, the greater the driver spin and the softer the cover, the greater the driver spin.

For example, when the intermediate layer is intended to be the hardest point in the ball, e.g., about 50 Shore D to about 75 Shore D, the cover material may have a hardness of about 20 Shore D or greater, preferably about 25 Shore D or greater, and more preferably about 30 Shore D or greater, as measured on the slab. In another embodiment, the cover itself has a hardness of about 30 Shore D or greater. In particular, the cover may be from about 30 Shore D to about 70 Shore D. In one embodiment, the cover has a hardness of about 40 Shore D to about 65 Shore D, and in another embodiment, about 40 Shore to about 55 Shore D. In another aspect of the invention, the cover has a hardness less than about 45 Shore D, preferably less than about 40 Shore D, and more preferably about 25 Shore D to about 40 Shore D. In one embodiment, the cover has a hardness from about 30 Shore D to about 40 Shore D.

In this embodiment when the outer cover layer is softer than the intermediate layer or inner cover layer, the ratio of the Shore D hardness of the outer cover material to the intermediate layer material is about 0.8 or less, preferably about 0.75 or less, and more preferably about 0.7 or less. In another embodiment, the ratio is about 0.5 or less, preferably about 0.45 or less.

In yet another embodiment, the ratio is about 0.1 or less when the cover and intermediate layer materials have hardnesses that are substantially the same. When the hardness differential between the cover layer and the intermediate layer is not intended to be as significant, the cover may have a hardness of about 55 Shore D to about 65 Shore D. In this embodiment, the ratio of the Shore D hardness of the outer cover to the intermediate layer is about 1.0 or less, preferably about 0.9 or less.

The cover hardness may also be defined in terms of Shore C. For example, the cover may have a hardness of about 70 Shore C or greater, preferably about 80 Shore C or greater. In another embodiment, the cover has a hardness of about 95 Shore C or less, preferably about 90 Shore C or less.

In another embodiment, the cover layer is harder than the intermediate layer. In this design, the ratio of Shore D hardness of the cover layer to the intermediate layer is about 1.33 or less, preferably from about 1.14 or less.

When a two-piece ball is constructed, the core may be softer than the outer cover. For example, the core hardness may range from about 30 Shore D to about 50 Shore D, and the cover hardness may be from about 50 Shore D to about 80 Shore D. In this type of construction, the ratio between the cover hardness and the core hardness is preferably about 1.75 or less. In another embodiment, the ratio is about 1.55 or less. Depending on the materials, for example, if a composition of the invention is acid-functionalized wherein the acid groups are at least partially neutralized, the hardness ratio of the cover to core is preferably about 1.25 or less.

Compression

Compression values are dependent on the diameter of the component being measured. Atti compression is typically used to measure the compression of a golf ball. As used herein, the terms "Atti compression" or "compression" are defined as the deflection of an object or material relative to the deflection of a calibrated spring, as measured with an Atti Compression Gauge, that is commercially available from Atti Engineering Corp. of Union City, N.J.

The Atti compression of the core, or portion of the core, of golf balls prepared according to the invention is preferably less than about 80, more preferably less than about 75. In another embodiment, the core compression is from about 40 to about 80, preferably from about 50 to about 70. In yet another embodiment, the core compression is preferably below about 50, and more preferably below about 25. In an alternative, low compression embodiment, the core has a compression less than about 20, more preferably less than about 10, and most preferably, 0. As known to those of ordinary skill in the art, however, the cores generated according to the present invention may be below the measurement of the Atti Compression Gauge.

In one embodiment, golf balls of the invention preferably have an Atti compression of about 55 or greater, preferably from about 60 to about 120. In another embodiment, the Atti compression of the golf balls of the invention is at least about 40, preferably from about 50 to 120, and more preferably from about 60 to 100. In yet another embodiment, the compression of the golf balls of the invention is about 75 or greater and about 95 or less. For example, a preferred golf ball of the invention may have a compression from about 80 to about 95.

Initial Velocity and COR

There is currently no USGA limit on the COR of a golf ball, but the initial velocity of the golf ball cannot exceed 250±5 feet/second (ft/s). Thus, in one embodiment, the initial velocity is about 245 ft/s or greater and about 255 ft/s or greater. In another embodiment, the initial velocity is about 250 ft/s or greater. In one embodiment, the initial velocity is about 253 ft/s to about 254 ft/s. In yet another embodiment, the initial velocity is about 255 ft/s. While the current rules on initial velocity require that golf ball manufacturers stay within the limit, one of ordinary skill in the art would appreciate that the golf ball of the invention would readily convert into a golf ball with initial velocity outside of this range. For example, a golf ball of the invention may be designed to have an initial velocity of about 220 ft/s or greater, preferably about 225 ft/s or greater.

As a result, of the initial velocity limitation set forth by the USGA, the goal is to maximize COR without violating the 255 ft/s limit. The COR of a ball is measured by taking the ratio of the outbound or rebound velocity to the incoming or inbound velocity. In a one-piece solid golf ball, the COR will depend on a variety of characteristics of the ball, including its composition and hardness. For a given composition, COR will generally increase as hardness is increased. In a two-piece solid golf ball, e.g., a core and a cover, one of the purposes of the cover is to produce a gain in COR over that of the core. When the contribution of the core to high COR is substantial, a lesser contribution is required from the cover. Similarly, when the cover contributes substantially to high COR of the ball, a lesser contribution is needed from the core.

The present invention contemplates golf balls having CORs from about 0.700 to about 0.850 at an inbound velocity of about 125 ft/sec. In one embodiment, the COR is about 0.750 or greater, preferably about 0.780 or greater. In another embodiment, the ball has a COR of about 0.800 or greater. In yet another embodiment, the COR of the balls of the invention is about 0.800 to about 0.815.

In addition, the inner ball preferably has a COR of about 0.780 or more. In one embodiment, the COR is about 0.790 or greater.

Spin Rate

As known to those of ordinary skill in the art, the spin rate of a golf ball will vary depending on the golf ball construction. In a multilayer ball, e.g., a core, an intermediate layer, and a cover, wherein the cover is formed from the polyurea or polyurethane compositions of the invention, the spin rate of the ball off a driver ("driver spin rate") may be about 2700 rpm or greater. In one embodiment, the driver spin rate is about 2000 rpm to about 3500 rpm. In another embodiment, the driver spin rate is about 2200 rpm to about 3400 rpm. In still another embodiment, the driver spin rate may be less than about 2700 rpm.

Two-piece balls made according to the invention may also have driver spin rates of 1500 rpm and greater. In one embodiment, the driver spin rate is about 2000 rpm to about 3300 rpm. Wound balls made according to the invention preferably have similar spin rates.

Methods of determining the spin rate should be well understood by those of ordinary skill in the art. Examples of methods for determining the spin rate are disclosed in U.S. Pat. Nos. 6,500,073, 6,488,591, 6,286,364, and 6,241,622, which are incorporated by reference herein in their entirety.

Flexural Modulus

Accordingly, it is preferable that the golf balls of the present invention have an intermediate layer with a flexural modulus of about 500 psi to about 500,000 psi, measured according to ASTM D-6272-98. More preferably, the flexural modulus of the intermediate layer is about 1,000 psi to about 250,000 psi. Most preferably, the flexural modulus of the intermediate layer is about 2,000 psi to about 200,000 psi.

The flexural modulus of the cover layer is preferably about 2,000 psi or greater, and more preferably about 5,000 psi or greater. In one embodiment, the flexural modulus of the cover is from about 10,000 psi to about 150,000 psi. More preferably, the flexural modulus of the cover layer is about 15,000 psi to about 120,000 psi. Most preferably, the flexural modulus of the cover layer is about 18,000 psi to about 110,000 psi. In another embodiment, the flexural modulus of the cover layer is about 100,000 psi or less, preferably about 80,000 or less, and more preferably about 70,000 psi or less. For example, the flexural modulus of the cover layer may be from about 10,000 psi to about 70,000 psi, from about 12,000 psi to about 60,000 psi, or from about 14,000 psi to about 50,000 psi.

In one embodiment, when the cover layer has a hardness of about 50 Shore D to about 60 Shore D, the cover layer preferably has a flexural modulus of about 55,000 psi to about 65,000 psi.

In one embodiment, the ratio of the flexural modulus of the intermediate layer to the cover layer is about 0.003 to about 50. In another embodiment, the ratio of the flexural modulus of the intermediate layer to the cover layer is about 0.006 to about 4.5. In yet another embodiment, the ratio of the flexural modulus of the intermediate layer to the cover layer is about 0.11 to about 4.5.

In one embodiment, the compositions of the invention are used in a golf ball with multiple cover layers having essentially the same hardness, but differences in flexural moduli. In this aspect of the invention, the difference between the flexural moduli of the two cover layers is preferably about 5,000 psi or less. In another embodiment, the difference in flexural moduli is about 500 psi or greater. In yet another embodiment, the difference in the flexural moduli between the two cover layers, wherein at least one is reinforced is about 500 psi to about 10,000 psi, preferably from about 500 psi to about 5,000 psi. In one embodiment, the difference in flexural moduli between the two cover layers formed of unreinforced or unmodified materials is about 1,000 psi to about 2,500 psi.

Specific Gravity

The specific gravity of a cover or intermediate layer is preferably at least about 0.7. In one embodiment, the specific gravity of the intermediate layer or cover is about 0.8 or greater, preferably about 0.9 or greater. For example, in one embodiment, the golf ball has an intermediate layer with a specific gravity of about 0.9 or greater and a cover having a specific gravity of about 0.95 or greater. In another embodiment, the intermediate layer or cover has a specific gravoty of about 1.00 or greater. In yet another embodiment, the specific gravity of the intermediate layer or cover is about 1.05 or greater, preferably about 1.10 or greater.

The core may have a specific gravity of about 1.00 or greater, preferably 1.05 or greater. For example, a golf ball of the invention may have a core with a specific gravity of about 1.10 or greater and a cover with a specific gravity of about 0.95 or greater.

While it is apparent that the invention disclosed herein is well calculated to fulfill the objects stated above, it will be appreciated that numerous modifications and embodiments may be devised by those skilled in the art. For example, while golf balls and golf ball components are used as examples for articles incorporating the compositions of the invention, other golf equipment may be formed from the compositions of the invention. In one embodiment, at least a portion of a golf shoe is formed from the composition of the invention. In another embodiment, the composition of the invention is used to form at least a portion of a golf club, e.g., a putter insert. Therefore, it is intended that the appended claims cover all such modifications and embodiments that fall within the true spirit and scope of the present invention.

We claim:

1. A golf ball comprising at least one structural layer formed of a microporous composition comprising:

at least one polymer component;

a finely divided particulate filler comprising at least about 50 percent by weight of siliceous particles; and a network of interconnecting pores communicating substantially throughout the microporous composition, wherein the finely divided particulate filler is present in an amount of about 40 percent or greater by weight of the microporous composition.

2. The golf ball of claim 1, wherein the finely divided particulate filler comprises precipitated silica, a silica gel, fumed silica.

3. The golf ball of claim 1, wherein the interconnecting pores have a volume average diameter of about 0.02 microns to about 50 microns.

4. The golf ball of claim 1, wherein the finely divided particulate filler has an average particle size of about 100 nm or less.

5. The golf ball of claim 1, wherein the finely divided particulate filler has an average particle size of about 5 microns to about 40 microns.

6. The golf ball of claim 1, wherein the polymer component comprises ionomer resins, grafted and ungrafted metallocene-catalyzed polymers, single site catalyzed olefinic polymers, polyurethanes, polyureas, polyurethane-ionomers, polyurea-ionomers, polybutadiene, polyisoprene, ethylene propylene rubber, ethylene propylene diene monomer, styrene diene rubber block copolymers, polyamide, polyester, polyester-amide block copolymers, polyester-ether block copolymers, polyethylene-acrylic copolymers, polyethylene-methacrylic acid copolymers, polyethylene-acrylic terpolymer, polyethylene-methacrylic acid terpolymers, or mixtures thereof.

7. The golf ball of claim 1, wherein the golf ball comprises a core, a cover, and at least one layer formed of the microporous composition disposed between the core and the cover.

8. A golf ball comprising a core and a cover, wherein the cover is formed of a microporous composition comprising:

a polymer component; and a finely divided silicate filler present in an amount of about 40 percent or greater by weight of the microporous composition, wherein the microporous composition comprises pores comprising about 35 percent or greater of the volume of the microporous composition, and wherein the pores have a volume average diameter of about 0.02 microns to about 50 microns.

9. The golf ball of claim 8, wherein the finely divided silicate filler has an average particle size of about 50 mm or less.

10. The golf ball of claim 8, wherein the pores comprise about 60 percent or greater of the volume of the microporous composition.

11. The golf ball of claim 8, wherein the pores have a volume average diameter of about 0.05 microns to about 30 microns.

12. The golf ball of claim 8, wherein the core comprises a rubber-based material.

13. The golf ball of claim 8, wherein the microporous composition further comprises a density-adjusting filler.

14. The golf ball of claim 8, wherein the microporous composition further comprises a processing plasticizer.

15. A golf ball comprising a structural layer formed of a microporous composition comprising:

a polymer comprising polyurethane, polyurea, ionomer resin, or mixture thereof;

a finely divided particulate filler comprising at least about 50 percent by weight of siliceous particles, wherein the finely divided particulate filler is present in an amount of about 40 percent or greater by weight of the microporous composition; and a network of interconnecting pores communicating substantially throughout the microporous composition.

16. The golf ball of claim 15, wherein the finely divided particulate filler comprises precipitated silica, silica gel, fumed silica, or a combination thereof.

17. The golf ball of claim 15, wherein the structural layer is a core layer.

18. The golf ball of claim 15, wherein the structural layer is a cover layer.

19. The golf ball of claim 18, further comprises a polybutadiene core and an ionomer resin inner cover layer, wherein the structural layer is disposed about the inner cover layer.

20. The golf ball of claim 15, wherein the network of interconnecting pores comprises about 35 percent to about 95 percent by volume of the microporous composition.

* * * * *